United States Patent [19]

Solheim et al.

[11] Patent Number: 4,834,235

[45] Date of Patent: May 30, 1989

[54] GOLF BAG WITH EXTENSIBLE SUPPORT STAND

[75] Inventors: John A. Solheim, Phoenix; Gregory J. Schmidt, Tempe, both of Ariz.

[73] Assignee: Karsten Manufacturing Corporation, Phoenix, Ariz.

[21] Appl. No.: 214,933

[22] Filed: Jul. 5, 1988

[51] Int. Cl.[4] ..... A63B 55/00; A63B 55/06

[52] U.S. Cl. ..... 206/315.7; 206/315.8; 248/96

[58] Field of Search ..... 206/315.2–315.8; 248/95–97, 168, 170; 280/646, DIG. 6; 211/70.2; 190/18 R

[56] References Cited

U.S. PATENT DOCUMENTS

| | | | |
|---|---|---|---|
| 846,552 | 3/1907 | Collins et al. | 248/96 |
| 1,181,007 | 4/1916 | Henneberg | 248/96 |
| 1,404,559 | 1/1922 | Watrous | 248/96 |
| 1,686,774 | 10/1928 | Sperry | 248/96 |
| 1,840,663 | 1/1932 | Gallagher | 248/96 X |
| 1,916,612 | 7/1933 | Galt | 248/96 |
| 1,970,849 | 8/1934 | Gunther | 248/96 |
| 2,282,842 | 5/1942 | Abell | 248/96 |
| 2,364,223 | 12/1944 | Keim | 206/315.3 |
| 2,628,801 | 2/1953 | Gunning | 248/96 |
| 4,506,854 | 3/1985 | Kim | 248/96 |
| 4,620,682 | 11/1986 | Yim | 248/96 |
| 4,676,464 | 6/1987 | Reimers | 206/315.5 X |

FOREIGN PATENT DOCUMENTS

| | | | |
|---|---|---|---|
| 155266 | 3/1921 | United Kingdom | 206/315.6 |
| 331668 | 7/1930 | United Kingdom | 206/315.6 |
| 2098075 | 11/1982 | United Kingdom | 248/97 |

*Primary Examiner*—Sue A. Weaver
*Attorney, Agent, or Firm*—Herbert E. Haynes, Jr.

[57] ABSTRACT

A lightweight carry bag for golf clubs is provided with an automatically extensible bag stand which supports the golf bag in a propped-up position whenever the golf bag is set down during the course of playing a game of golf. The bag stand is configured to operate in the manner of a toggle mechanism with the operating force being derived from a partial longitudinal collapsing of the carry bag which occurs when the bag is set down on the ground in a vertical attitude and leaned over slightly in the direction of a partially collapsible side of the golf bag.

15 Claims, 3 Drawing Sheets

GOLF BAG WITH EXTENSIBLE SUPPORT STAND

BACKGROUND OF THE INVENTION

1. Field of the Invention

This invention relates in general to golf equipment and more particularly to a lightweight golf bag with extensible support stand.

2. Description of the Prior Art

Golf clubs have been stored, carried and otherwise transported in especially designed bags for many years. Most golf bags are in the form of a tubular fabric container which is about three feet long and of generally cylindrical configuration with a closed bottom end and open top throat through which golf clubs are inserted into and removed from the bag. Also, golf bags usually include one or more pockets for carrying golf bags, tees and the like, and a handle and shoulder strap are provided to facilitate carrying of the bag.

Although golf bags are manufactured in a variety of sizes and materials so as to better suit various intended uses and to satisfy personal preferences, they are conventionally grouped into two basic classes. The first of these two basic classes includes the relatively large and heavy bags which are not very well suited for carrying by the golfer while playing. The second basic class of golf club bags are generally smaller and lighter than the first type and are designed to be carried by the golfer.

The first class of golf bags are usually from about 9 to 12 inches in diameter and are fabricated of a relatively heavy and stiff material such as leather and synthetic leather. In addition, reinforcing materials such as metal straps, wire frames or the like are incorporated as integral parts of the bags so that they are rigid self-supporting structures. due to the configuration and physical size, the larger diameter bags of this first class are very rarely carried by the golfer during his or her playing of the game. Instead, these bags are usually transported on a pull cart, motorized cart or are carried for the golfer by a caddie. The smaller diameter golf bags of this first class, such as those having diameters of 9 or 10 inches, are constructed in the same basic manner but are considerably less bulky and, of course, weight less. Due to the reduction in bulk and weight, some golfers elect to carry these smaller diameter bags while playing and others carry them on carts or use caddies in the same manner as the larger bags.

The second classification of golf bags are generally smaller and considerably lighter than those of the first class and are especially configured to facilitate carrying by the golfer during play. These bags, which are often referred to in the art as "carry bags", are fabricated of light weight materials such as synthetic resin so that the various components such as the molded ring-shaped throat structure and the bottom closure are of minimal weight. The largest weight reduction is accomplished by replacing the leather or synthetic leather tubular body of the larger and heavier bags with a light weight fabric such as nylon in the carry bags, and eliminating metal straps, wire frames and/or other integral reinforcing structures. By using the lightweight fabric and doing away with the integral reinforcing structures, carry bags are not self-supporting in the same sense as the first class of golf bags and are considered as being collapsible structures. The needed rigidity is derived from a removable support which is disposed within the bore of the fabric tubular body so as to extend between the throat and bottom closure components of the bag.

In one type of carry bag, the removable support is in the form, of a wooden dowel which is carried in a fabric sleeve which is sewn into the fabric body so as to extend between the bottom closure and the top throat of the bag. In another type of carry bag shown in U.S. Pat. No. 4,506,854, the support includes a shaft which is axially disposed in the tubular body. A base is carried on the lower end of the shaft for supporting the shaft in its axial position in the bottom closure and a upper brace is provided for a similar purpose and for dividing the throat structure into plural club segregating areas.

Although many golfers who walk and carry their clubs themselves do so for the exercise, many of them dislike the repeated bending over whenever the golf bag they are carrying must be set down or picked up during the course of play. Further, most golfers dislike setting their golf bags and clubs down in wet grass or dirt. For these reasons, extensible bag stands have been devised for supporting golf bags in a substantially upright position whenever a golfer sets the bag down.

U.S. Pat. No. 2,282,842 which issued on May 12, 1942 to H. Q. Abell, shows an early attempt at providing an extensible stand that will prop up a golf bag so as to eliminate the repeated bending over and other undesirable aspects of the above described problem. This particular extensible stand includes cables, pull levers, springs and the like, all of which are built into the golf bag with the bag being especially configured to house and interact with the stand mechanism. As a result, this prior art combination golf bag with extensible stand is a relatively complex structure which is expensive and difficult to manufacture.

A widely used and well known extensible golf bag stand has been devised for demountable attachment to the side of golf bags, and a stand of this type is shown and described in the hereinbefore referenced U.S. Pat. No. 4,506,854. As shown, extensible stands of this sort include an elongated tubular rod which extends the full length of the golf bag and has arcuate saddle members at its top and bottom ends. The saddle members are configured and positioned to engage the ring-shaped throat and bottom closure of the golf bag and suitable straps are employed to demountably attach the saddles and thus the tubular rod, to the side of the golf bag. An extensible leg assembly is pivotably mounted on the tubular rod for movement between a retracted position in which the leg assembly is disposed when the bag is being carried, and an extended position in which the leg assembly is disposed whenever the bag is being supported in a propped up attitude by the bag stand. An especially configured actuator rod is connected to the leg assembly and is movably carried in a retainer provided on the arcuate saddle located on the bottom end of the tubular rod. The actuator rod has a lower end which normally extends below the bottom of the bag so as to automatically produce a generally upward sliding movement of the actuator rod relative to the bag whenever the bag is set down on its bottom closure. Such upward movement of the actuator rod produces movement of the leg assembly into its extended position and, when the bag is picked up, the actuator rod returns to its downwardly disposed normal position and in doing so, automatically returns the leg assembly to its retracted position.

Considerable effort has been expended in producing carry bags of minimum weight and bulk, and many of the currently available carry bags weigh about two pounds. The prior art automatic gold bag stands of the latter type discussed above, also weight about two pounds and when added to a carry bag will double the weight and add considerable bulk. Thus, these prior art bag stands are less than ideally suited for use with lightweight carry bags in that they are not in keeping with the minimized weight and bulk objectives of the lightweight carry bags.

Therefore, a need exists for a new and improved lightweight golf bag in combination with an automatic bag stand which is of minimum weight, bulk and complexity so as to overcome some of the shortcomings of the prior art.

SUMMARY OF THE INVENTION

In accordance with the present invention, a new and improved lightweight carry bag for golf clubs in combination with an automatically extensible bag stand of minimal complexity, weight and bulk is disclosed.

The golf bag portion of the disclosed combination includes a bottom closure, a ring-shaped throat and an interconnecting light weight fabric body in addition to the various other things usually found in a golf bag such as a shoulder strap, accessory pocket and the like. In that the interconnecting body is formed of a lightweight fabric, the bag would be totally collapsible were it not for a rigidifying strut which holds the bag in the general form of a right circular cylinder. The rigidifying strut is preferably in the form of a wooden dowel that is demountably mounted in laterally spaced relationship with respect to the longitudinal axis of the bag so that its location is that of an element of the right circular cylinder.

Since the rigidification of the golf bag is derived from the strut which is located so as to form an element of the right circular cylinder, the diametrically opposite side of the golf bag remains at least partially collapsible, and it is this characteristic which is employed to operate the bag stand portion of the disclosed combination.

The bag stand portion of this combination is mounted on the partially collapsible side of the golf bag and includes a pair of legs the upper ends of which are pivotably attached to the ring-shaped throat of the golf bag so the legs are pendulously suspended from the these top, or first pivot points of the bag stand. An actuator rod of generally U-shaped configuration has a bight portion that is pivotably attached to the bottom closure of the bag with that pivot connection forming the bottom, or second, pivot point of the bag stand. The actuator rod further includes a pair of arms which extend upwardly from the bottom pivot point and are each pivotably connected to a different one of the legs at points intermediate the top and bottom ends of the legs with these latter pivot connections forming the intermediate, or third, pivot points of the bag stand.

Whenever the golf bag is in its normal position, i.e. in the form of a right circular cylinder as it will be for example when it is being carried, the distance between the ring-shaped throat and the bottom closure will be at a maximum. This, of course, results in the distance between the top and bottom pivot points of the bag stand being at a maximum. In this state, the three pivot points of the bag stand will be in substantial alignment, with the intermediate pivot points being slightly under center, and when so aligned, the legs of the stand will be in a retracted position. When retracted, the legs of the bag stand are firmly held against the side of the bag and thus will not interfere with any normal activities of the golfer.

When a golfer wishes to set the golf bag of the present invention down and actuate the bag stand thereof, a simple and natural movement of setting the bag down on its bottom closure and leaning it over slightly will automatically move the legs of the stand into an extended position wherein the bag is supported in a propped-up position by the stand. When the golf bag is being set down, the leaning motion is allowed to occur in the direction of the partially collapsible side of the golf bag, and this motion inherently decreases the distance between the top and bottom pivot points of the bag stand. When those two pivot points are moved closer together, the intermediate pivot points will move away from the side of the golf bag in a motion which may be described as a toggle action of the legs and actuator rod of the stand. When the golf bag is subsequently picked up, the top and bottom pivot points will move back into their maximum spaced apart positions, and in accomplishing this movement, the intermediate pivot points will move back into their slightly under center alignment with the top and bottom pivot points in a reversed motion of the above described toggle action.

The automatic bag stand portion of the combination of the present invention includes a lightweight clevis means by which the top ends of the legs of the stand are pivotably attached to the ring-shaped throat of the golf bag. The bight portion of the actuator rod is pivotably attached to the golf bag proximate the bottom closure by means of a fabric loop which is stitched or otherwise formed integrally on the golf bag proximate the bottom closure.

By utilizing an inherent characteristic of a particular type of golf bag to operate an automatically extensible bag stand, the golf bag and stand combination of the present invention significantly reduces the shortcomings of the prior art by minimizing the weight, bulk and complexity of such a combination.

Accordingly, it is an object of the present invention to provide a new and improved lightweight carry bag for golf clubs in combination with an automatically extensible bag stand. The combination golf bag and stand utilizes an inherent characteristic of the golf bag to automatically operate the stand so that the combination is of minimal weight, bulk and complexity.

The foregoing and other characteristics and objects of the present invention as well as the invention itself, may be more fully understood from the following description when read in conjunction with the accompanying drawings.

DESCRIPTION OF THE PREFERRED EMBODIMENT

Figure 1:
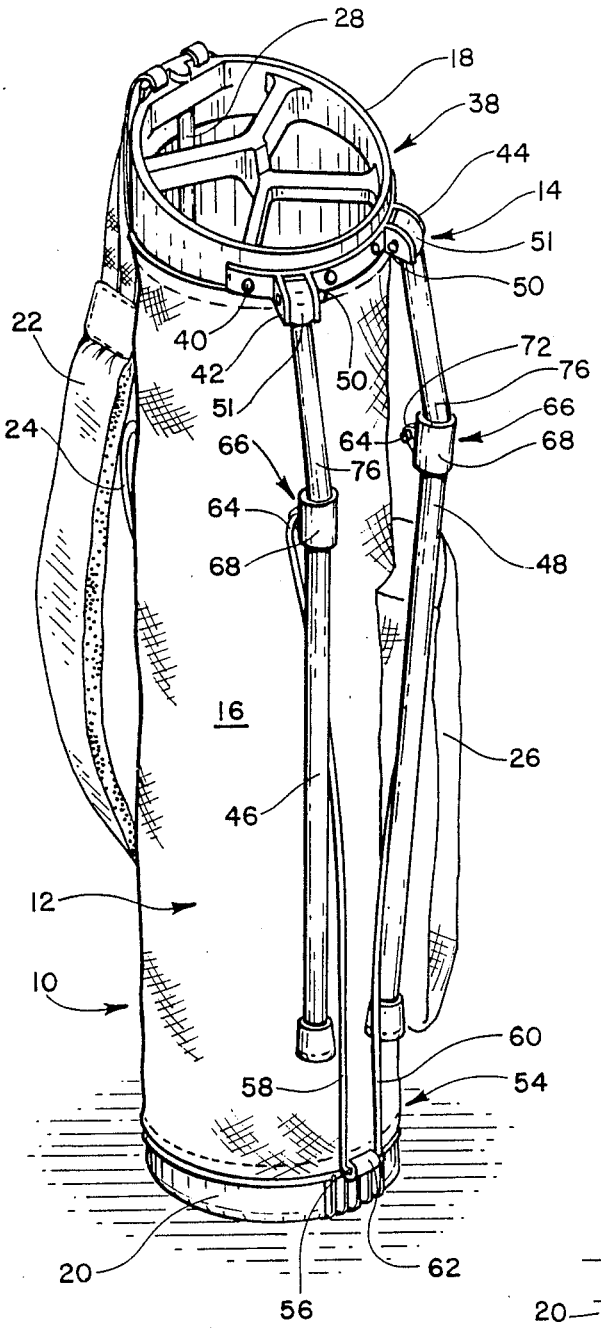
FIG. 1 is a perspective view of the golf bag and stand combination of the present invention showing the various features thereof.
Figure 3:
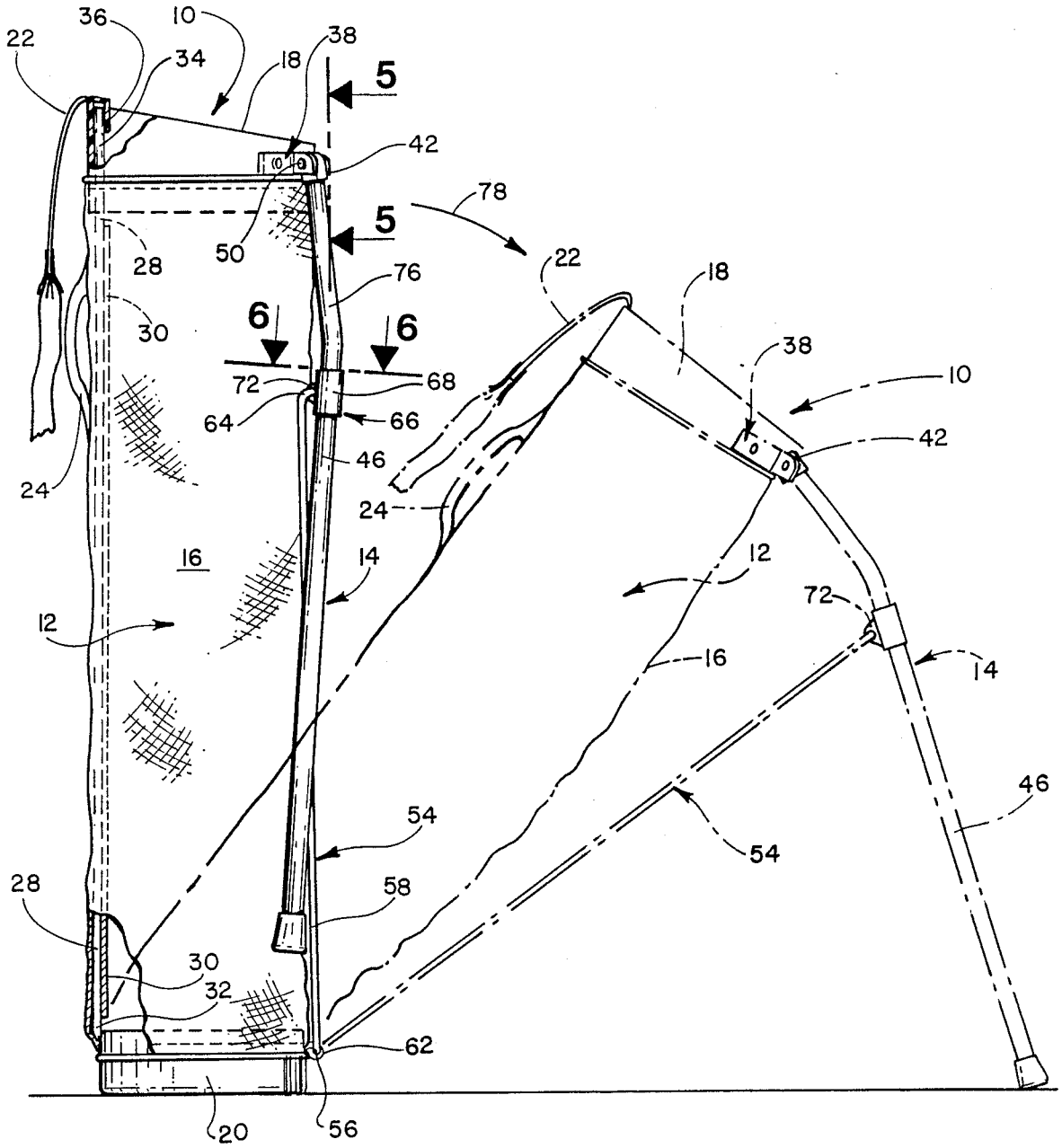
FIG. 3 is side elevational view of the golf bag/bag stand combination of the present invention with portions thereof being broken away to show the various features thereof, and showing the bag in an upright position in solid lines and in a propped-up position in dashed lines.
Figure 4:
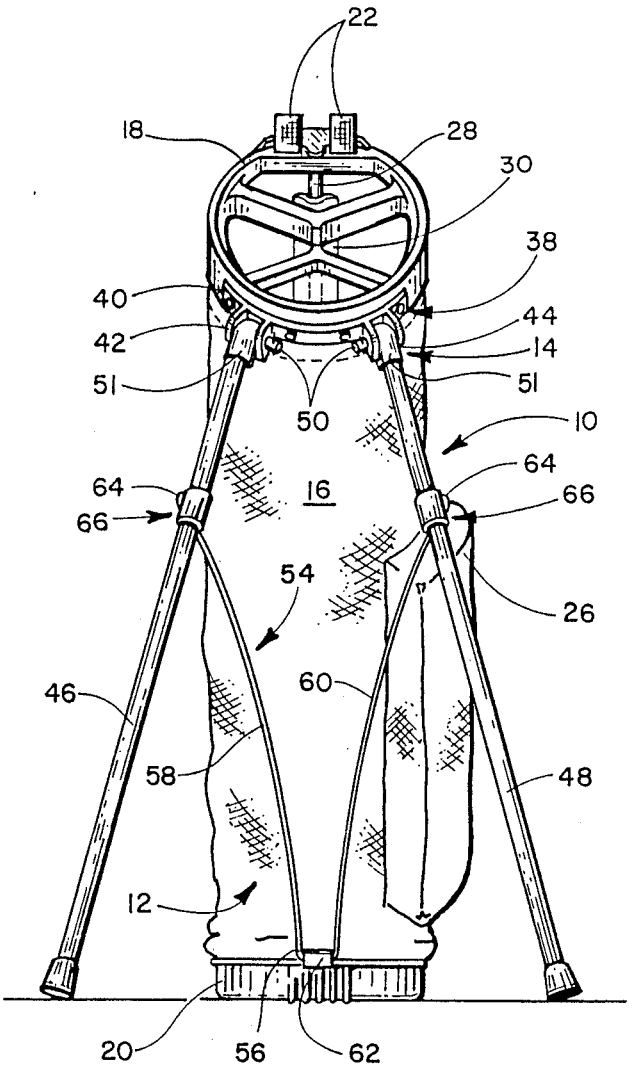
FIG. 4 is a front elevational view of the golf bag/bag stand combination of the present invention.

Referring more particularly to the drawings, FIGS. 1,3 and 4 best show the golf bag/bag stand combination of the present invention with the combination structure being indicated generally by the reference numeral 10. As will hereinafter be described in detail, the golf bag/-bag stand combination 10 includes two major components, or subassemblies, namely the golf bag which is indicated in its entirety by the reference numeral 12, and the bag stand which is indicated in its entirety by the reference numeral 14.

The illustrated golf bag 12 is of the type commonly referred to in the art as a "carry bag" in that it is designed and fabricated of lightweight materials to facilitate its being carried by a golfer while he is playing golf. Such carry bags have a tubular body 16 that is formed of a lightweight fabric such as nylon. A ring-shaped throat structure 18 is stitched or otherwise mounted in the top end of the fabric body 16 with the throat being designed to segregate golf clubs (not shown) into predetermined groupings, with the golf clubs being inserted into and removed from the bag through the throat 18 as is customary. A bottom closure 20 is similarly mounted in the bottom end of the tubular fabric body 16. Both the throat structure 18 and the bottom closure 20 are preferably molded or otherwise formed of a suitable synthetic resin in the manner well known in the art.

The golf bag 12 may also include the various other things normally associated with golf bags such as a shoulder strap 22, handle 24, accessory pocket 26 and the like.

In that the golf bag 12 is formed with a lightweight tubular fabric body 16, the golf bag would be completely collapsible in the direction of its longitudinal axis were it not for a rigidifying strut 28 which is best seen in FIG. 3. As shown, the rigidifying strut 28 is in the form of an elongated dowel which may be fabricated of wood, fiberglass or other suitable rigid but lightweight material. The strut 28 is demountably carried in an elongated sleeve 30 that is sewn or otherwise formed as an integral part of the tubular fabric body 16 during fabrication thereof. The lower end 32 of the rigidifying strut 28 extends from the open bottom end of the sleeve 30 and is disposed proximate the bottom closure 20 in the manner shown. The top end 34 of the rigidifying strut 28 extends upwardly from the open end of the sleeve 30 and is captively retained in a downwardly opening pocket 36 formed in the throat structure 18 for that purpose.

When the golf bag 12 is standing in the upright position as shown in solid lines in FIG. 3, it is, by geometric definition in the approximate form of a right circular cylinder, and the rigidifying strut 28 is in the position of an element of the right circular cylinder. In other words, the strut is spaced laterally from the longitudinal axis of the golf bag so as to lie proximate the circular sidewall of the bag and is parallel with the longitudinal axis. Since the rigidifying strut 28 is offset as described above, the diametrically opposed side of the golf bag is at least partially collapsible and it is this characteristic which is used to operate the golf bag stand 14 as will hereinafter be described in detail.

The golf bag stand 14 includes a mounting bracket means 38 having an arcuate strap member 40 which is riveted or otherwise mounted fast on the peripheral wall of the ring-shaped throat 18 of the golf bag 12. The mounting bracket means 38 is especially configured to provide a spaced apart pair of clevis members 42 and 44 which are disposed so as to extend radially from the throat 18 of the golf bag and thus divergingly extend with respect to each other.

Figure 5:
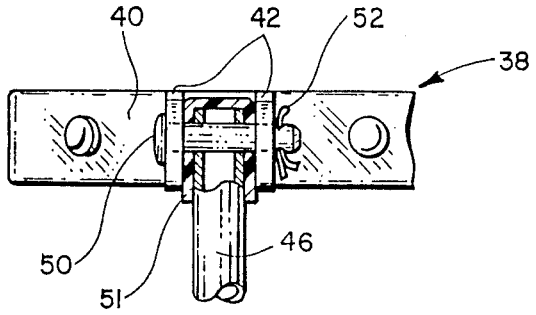
FIG. 5 is an enlarged fragmentary sectional view taken along the line 5—5 of FIG. 3.

A pair of legs 46 and 48 are mounted so as to be pendulously suspended from the clevis members 42 and 44 respectively by means of the illustrated pivot pins 50. The legs 46 and 48 are configured and mounted to their respective clevis members in identical manner; thus, the following description of the mounting of the leg 46 to the clevis 42 will be understood to also apply to the mounting of the other leg 48. As seen in FIG. 5, the leg 46 has a cap 51 mounted on its top end which closes the otherwise open top end of the leg. The cap is preferably formed of a self-lubricating material such as nylon to provide a smoothly operating pivot connection. The pivot pin 50 passes through suitable apertures formed in the clevis 42 and transversely through the cap 51 and top end of the leg 46 as shown, with the pivot pin being held in place by any suitable means such as the illustrated cotter key 52.

The golf bag stand 14 further includes an actuator rod 54 of substantially U=shaped configuration having a bight portion 56 with a pair of arms 58 and 60 which extend upwardly from opposite ends of the bight portion. For reasons which will hereinafter be described in detail, the actuator rod 54 is pivotably attached to the golf bag 12 by means of a fabric loop 62 in which the bight portion 56 of the actuator rod is loosely disposed. The fabric loop 62 is preferably sewn into the golf bag at the time of its manufacture and is located proximate the bottom closure 20 of the golf bag on the partially collapsible side thereof.

Figure 6:
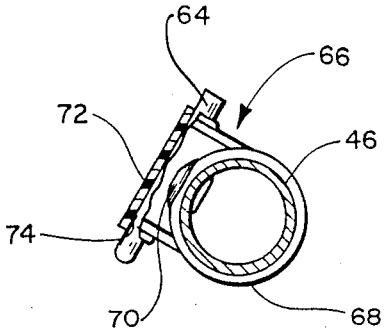
FIG. 6 is an enlarged fragmentary sectional view taken along the line 6—6 of FIG. 3.

The arms 58 and 60 of the actuator rod 54 have their top ends 64 bent inwardly toward each other for pivotable connection to the legs 46 and 48 of the golf bag stand 14. Special fittings 66 are mounted on the legs 46 and 48 at points proximate but spaced below the top ends of the legs to accomplish the pivot connection of the actuator rod 54 to the legs. Special reference is now made to FIG. 6 wherein a typical one of the special fittings 66 is best seen. Each of the fittings 66 includes a tubular body 68 which s coaxially disposed on its respective one of the legs 46 and 48, and is fixedly attached in the desired position such as by means of a rivet 70. A sleeve member 72 is integrally formed on the tubular body 68 and defines a bore 74 that is transverse with respect to the bore of the tubular body 68. The bore 74 of the sleeve 72 is configured for pivotable mounting of the top end 64 of one of the arms of the actuator rod 54 therein. As was the case with the above described caps 51, the special fittings 66 are preferably formed of a self-lubricating material to provide smoothly operating pivot joints.

When the arms 58 and 60 of the actuator rod 54 are connected to the special fittings 66, the upper ends 64 of the arms are held in spaced apart positions and this creates a force by which the upper ends of the arms are biased toward each other. This biasing force eliminates the need for any mounting hardware which would otherwise be needed to retain the upper ends 64 of the arms in pivotable connection with the special fittings 66. In addition, this biasing force aids in pulling the legs 46 and 48 back from their extended positions to their retracted positions.

The legs 46 and 48 of the bag stand 14 are bent slightly as at 76 immediately above the pivot interconnection of the actuator rod 54 and the legs. This insures that the lower ends of the legs 46 and 48 will be flat against the side of the bag when in the retracted state as shown in FIGS. 1 and 3. Further, bending of the legs in this manner, insures that the pivot connection of the actuator rod 54 to the legs 46 and 48 remain in an under-center position as will hereinafter be described.

Figure 2A:
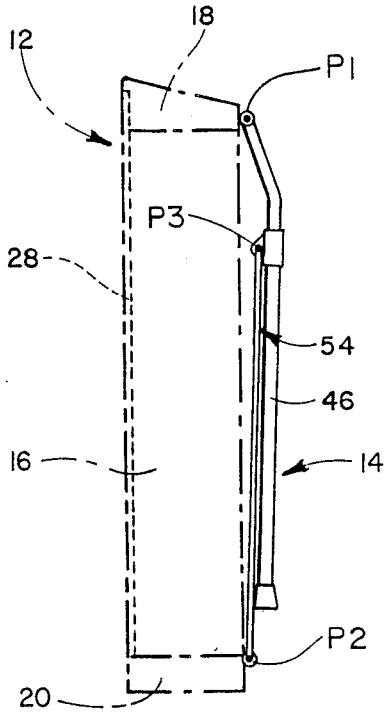
FIG. 2*a* is a diagrammatic view showing the bag stand in its retracted position.
Figure 2B:
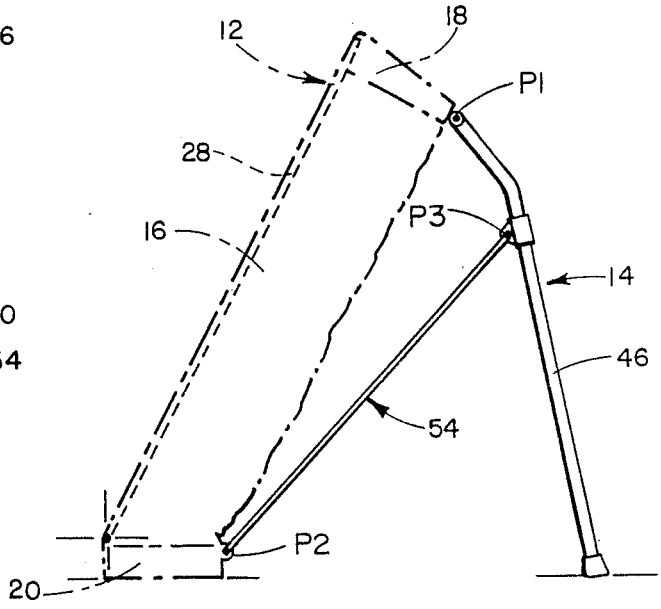
FIG. 2*b* is a diagrammatic view showing the bag stand in its extended position.

In order to clearly understand the automatic operation of the golf bag/bag stand combination 10 of the present invention, reference is now made to the diagrammatic views of FIGS. 2a and 2b. For purpose of this description, the pivot connection of the upper ends of the legs 46 and 48 to the ring-shaped throat 18 of the golf bag 12 will be identified as the top, or first pivot points (P1) of the bag stand. The lower pivot connection of the bight portion 56 of the actuator rod 54 proximate the bottom closure 20 of the bag 12 forms the bottom, or second, pivot connection (P2) of the bag stand, and the pivot connection of the actuator rod 54 to the legs 46 and 48 provides an intermediate, or third, pivot point (P3) of the bag stand.

When the golf bag 12 is in the normal position shown in Fig. 2a, as it will be whenever it is being carried or held in an upright position, the bag will be in the general form of a right circular cylinder. In such a state, the distance between top pivot points P1 and the bottom pivot point P2 will be at a maximum and the intermediate pivot P3 will be substantially aligned with the top and bottom points P1 and P2. It is in this position where the hereinbefore mentioned slightly under-center positioning of the intermediate pivot points P3 are important to insure a proper extension of the legs 46 and 48 when it is desired to prop up the golf bag with the stand.

When the golf bag 12 is to be propped up, the person carrying the bag needs to set the bag down on the ground so that it is standing in a vertical attitude on its bottom closure 20, and then allow the bag to lean in the direction of its partially collapsible side as indicated by arrow 78 in FIG. 3. This simple and natural movement produces an automatic movement of the bag stand from its retracted position to its extended position. The automatic movement is a direct result of a partial collapse of the partially collapsible side of the golf bag which moves the top and bottom pivot points P1 and P2 toward each other, and when this occurs, the intermediate pivot points P3 will be pushed away from the side of the bag in a motion which may be described as a toggle action of the actuator rod 54 and the legs which interact to form a toggle mechanism. The return motion of the bag stand 14 from its extended position to its retracted position is also automatic and will occur as a direct result of the golfer picking the bag up.

While the principles of the invention have now been made clear in the illustrated embodiment, there will be immediately obvious to those skilled in the art, many modifications of structure, arrangements, proportions, the elements, materials and components used in the practice of the invention and otherwise, which are particularly adapted for specific environments and operation requirements without departing from those principles.

For example, the mounting bracket means 38 is shown and described as being manufactured as a separate component that is attached to the side of the ring-shaped throat 18. The same objective of pivotably attaching the top ends of the legs 46 and 48 could be accomplished by molding or otherwise forming suitable attachment devices as integral parts of the ring-shaped throat 18.

The appended claims are therefore intended to cover and embrace any such modifications within the limits only of the true spirit and scope of the invention.

What we claim is:

1. A golf bag and an automatically extensible bag stand for supporting said golf bag in a propped-up position, said golf bag and bag stand comprising in combination:

(a) a golf bag having an elongated collapsible tubular body with a rigidifying strut extending longitudinally of said golf bag, said rigidifying strut being disposed to lie along one side of tubular body so that the diametrically opposed side is partially collapsible in that it may be moved from the longitudinally extended position to a partially collapsed position; and (b) an automatically extensible bag stand means mounted on the partially collapsible side of said golf bag, said stand means being in the form of a toggle mechanism so that it moves from a retracted position to an extended position upon partial collapsing of the collapsible side of said golf bag.

2. A golf bag and automatically extensible bag stand as claimed in claim 1 wherein said bag stand means comprises:

(a) leg means having a top end coupled at a first pivot joint means proximate the top end of said golf bag so as to be pendulously suspended from said first pivot joint means;

(b) actuator rod means having a bottom end coupled at a second pivot joint means proximate the bottom end of said golf bag, said actuator rod means extending upwardly from said second pivot joint means and having a top end; and (c) third pivot joint means pivotably connecting the top end of said actuator rod means to said leg means at a location which is spaced from said first pivot joint means.

3. A golf bag and automatically extensible bag stand as claimed in claim 2 and further comprising said first and said second pivot joint means lying in a plane with said third pivot joint means being in a slightly under center position when the partially collapsible side of said golf bag is in the longitudinally extended position and moves further away from the plane of said first and second pivot joint means when the partially collapsible side of said golf bag is moved to its partially collapsed position.

4. A golf bag and automatically extensible bag stand as claimed in claim 2 wherein said golf bag comprises:

(a) a ring-shaped throat structure mounted on one end of said collapsible tubular body to form the top end of said golf bag, said ring-shaped throat structure having a peripheral surface to which said leg means is pivotably coupled; and (b) a bottom closure structure mounted on the other end of said collapsible tubular body to form the bottom end of said golf bag.

5. A golf bag and automatically extensible bag stand as claimed in claim 4 wherein said leg means comprises a pair of legs each of which is pivotably connected to the peripheral surface of said ring-shaped throat structure in spaced apart positions with these two pivot connections cooperatively forming said first pivot joint means.

6. A golf bag and automatically extensible bag stand as claimed in claim 5 wherein said actuator rod means is of substantially U-shaped configuration and comprises:

(a) a bight portion which forms the bottom end of said actuator rod means;

(b) means on said golf bag and interacting with said bight portion to form said second pivot joint means;

(c) a pair of arms each extending upwardly from opposite sides of said bight portion with each of said pair of arms having a top end with these two top ends cooperatively forming the top end of said actuator rod means; and (d) said pair of arms of said actuator rod means each having its top end pivotably connected to a different one of said pair of legs to cooperatively form said third pivot joint means.

7. A golf bag and automatically extensible bag stand as claimed in claim 6 and further comprising:

(a) said pair of legs being mounted on said ring-shaped throat structure so as to depend in a substantially parallel retracted position from said first pivot joint means whenever the partially collapsible side of said golf bag is in its longitudinally extended position, said pair of legs being movable into an angularly and downwardly diverging extended position whenever the partially collapsible side of said golf bag is moved to its partially collapsed position; and (b) said pair of arms of said actuator rod means being configured and connected to said pair of legs in a manner which biasingly urges said pair of legs into the retracted position thereof.

8. A golf bag and automatically extensible bag stand as claimed in claim 1 wherein said bag stand means comprises:

(a) a pair of legs each having a top end;

(b) means for pivotably mounting the top ends of said pair of legs in spaced apart positions proximate the top of said golf bag to provide said bag stand means with a first pivot joint means from which said pair of legs are pendulously suspended;

(c) an actuator rod of substantially U-shaped configuration with a bight portion at its lower end and a pair of arms extending upwardly from the opposite ends of said bight portion;

(d) means for pivotably attaching the bight portion of said actuator rod to said golf bag at a point proximate the bottom end of said golf bag to provide said bag stand means with a second pivot joint means; and (e) third pivot joint means for pivotably attaching the upper end of each of said pair of arms of said actuator rod to a different one of said pair of legs at points spaced from said first pivot joint mean.

9. A golf bag stand and automatically extensible bag stand as claimed in claim 8 and further comprising said first and said second pivot joint means lying in a plane with said third pivot joint means being in a slightly under center position relative to that plane when the partially collapsible side of said golf bag is in the longitudinally extended position, said third pivot joint means being moved further away from the plane of said first and said second pivot joint means when the partially collapsible side of said golf bag is moved to its partially collapsed position.

10. A golf bag and automatically extensible bag stand as claimed in claim 9 and further comprising:

(a) said pair of legs being pivotably mounted proximate the top of said golf bag so as to depend in a substantially parallel retracted position from said first pivot joint means whenever the partially collapsible side of said golf bag is in its longitudinally extended position, said pair of legs being movable to an angularly and downwardly diverging extended position whenever the partially collapsible side of said golf bag is moved to its partly collapsed position; and (b) said pair of arms of said actuator rod means being configured and connected to said pair of legs in a manner which biasingly urges said pair of legs into the retracted position thereof.

11. A golf bag and an automatically extensible bag stand for supporting said golf bag in a propped-up position, said golf bag and bag stand comprising:

(a) a golf bag including,

I. an elongated collapsible tubular body,

II. a ring-shaped throat mounted in one end of said tubular body,

III. a bottom closure in the other end of said tubular body,

IV. a rigidifying strut in said tubular body and extending longitudinally of said golf bag from said ring-shaped throat to said bottom closure, said rigidifying strut being disposed to lie along one side of said tubular body with the diametrically opposed side being partially collapsible in a movement from a longitudinally extended position to a partially collapsed position; and (b) an automatically extensible bag stand means mounted on the partially collapsible side of said golf bag so that it moves from a retracted position to an extended position upon partial collapsing of the collapsible side of said golf bag, said bag stand means including, I. leg means having a top end coupled to the side of said ring-shaped throat by a first pivot joint means with said leg means being pendulously suspended therefrom, II. actuator rod means having a bottom end coupled at a second pivot joint means proximate said bottom closure, said actuator rod means extending upwardly from said second pivot joint means and having a top end, III. third pivot joint means pivotably connecting the top end of said actuator rod means to said leg means at a location which is proximate but spaced from said first pivot joint means.

12. A golf bag and an automatically extensible bag stand as claimed in claim 11 and further comprising, said first and said second pivot joint means being disposed to substantially lie in a plane with said third pivot joint means being spaced slightly from the plane in an under center position relative to said first and said second pivot joint means when the partially collapsible side of said golf bag is in its longitudinally extended position, said leg means and said actuator rod means being movable in a toggle action to move said third pivot joint means away from the plane of said first and said second pivot joint means when the partially collapsible side of said golf bag is moved to its partially collapsed position.

13. A golf bag and automatically extensible bag stand as claimed in claim 11 wherein said leg means comprises a pair of legs each of which is pivotably connected to the side of said ring-shaped throat in spaced apart positions with those two pivot connections cooperatively forming said first pivot joint means.

14. A golf bag and automatically extensible bag stand as claimed in claim 13 wherein said actuator rod means is of substantially U-shaped configuration and comprises:

(a) a bight portion which forms the bottom end of said actuator rod means;

(b) means on said golf bag and interacting with said bight portion to form said second pivot joint means;

(c) a pair of arms each extending upwardly from opposite sides of said bight portion with each of said pair of arms having a top end with these two top ends cooperatively forming the top end of said actuator rod means; and (d) said pair of arms of said actuator rod means each having its top end pivotably connected to a different one of said pair of legs to cooperatively form said third pivot joint means.

15. A golf bag and automatically extensible bag stand as claimed in claim 14 and further comprising:

(a) said pair of legs being mounted on said ring-shaped throat so as to depend in a substantially parallel retracted position from said first pivot joint means whenever the partially collapsible side of said golf bag is in its longitudinally extended position, said pair of legs being movable to an angularly and downwardly diverging extended position whenever the partially collapsible side of said golf bag is moved to its partially collapsed position; and (b) said pair of arms of said actuator rod means being configured and connected to said pair of legs in a manner which biasingly urges said pair of legs into the retracted position thereof.

* * * * *